US010337480B2

(12) United States Patent
Tokuo et al.

(10) Patent No.: US 10,337,480 B2
(45) Date of Patent: Jul. 2, 2019

(54) HIGH-PRESSURE FUEL PUMP AND CONTROL DEVICE

(71) Applicant: Hitachi Automotive Systems, Ltd., Hitachinaka-shi, Ibaraki (JP)

(72) Inventors: Kenichiro Tokuo, Hitachinaka (JP); Ryo Kusakabe, Hitachinaka (JP); Shunsuke Aritomi, Tokyo (JP); Satoshi Usui, Hitachinaka (JP); Masayuki Suganami, Hitachinaka (JP); Minoru Hashida, Hitachinaka (JP); Masamichi Yagai, Hitachinaka (JP); Yuta Saso, Hitachinaka (JP); Atsuji Saito, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/580,480

(22) PCT Filed: Aug. 1, 2016

(86) PCT No.: PCT/JP2016/072466

§ 371 (c)(1),
(2) Date: Dec. 7, 2017

(87) PCT Pub. No.: WO2017/056681

PCT Pub. Date: Apr. 6, 2017

(65) Prior Publication Data

US 2018/0238287 A1 Aug. 23, 2018

(30) Foreign Application Priority Data

Sep. 30, 2015 (JP) ..... 2015-192529

(51) Int. Cl.
*F02M 63/00* (2006.01)
*F02M 51/04* (2006.01)
(Continued)

(52) U.S. Cl.
CPC ..... *F02M 63/0017* (2013.01); *F02M 51/04* (2013.01); *F02M 59/36* (2013.01);
(Continued)

(58) Field of Classification Search
CPC .. F02M 63/0017; F02M 59/466; F02M 51/04; F02M 59/46; F02M 59/36; F02M 2200/09; F02M 59/368; F02M 59/462
See application file for complete search history.

(56) References Cited

U.S. PATENT DOCUMENTS 4,708,116 A * 11/1987 Gaa ..... F02M 59/36 123/300
5,476,245 A * 12/1995 Augustin ..... F02M 47/027 239/533.8
(Continued)

FOREIGN PATENT DOCUMENTS

EP 3 187 725 A1 7/2017
EP 3 315 760 A1 5/2018
(Continued)

OTHER PUBLICATIONS

International Search Report (PCT/ISA/210) issued in PCT Application No. PCT/JP2016/072466 dated Oct. 11, 2016 with English translation (Two (2) pages).
(Continued)

*Primary Examiner* — Joseph J Dallo
(74) *Attorney, Agent, or Firm* — Crowell & Moring LLP

(57) ABSTRACT

Provided is a high-pressure fuel pump in which responsiveness of closing a suction valve can be maintained even when the high-pressure fuel pump is increased in pressure or capacity of the high-pressure fuel pump is increased, thereby ensuring discharge efficiency. Therefore, the high-pressure fuel pump includes the rod that urges the suction valve in the valve opening direction, the mover that drives the rod in the
(Continued)

valve closing direction, and the solenoid that generates a magnetic attraction force for moving the mover in the valve closing direction. After the suction valve starts moving from the suction valve closing position in the valve opening direction, the rod reaches the suction valve closing position and further moves in the valve opening direction.

11 Claims, 7 Drawing Sheets

(51) Int. Cl.
*F02M 59/36* (2006.01)
*F02M 59/46* (2006.01)

(52) U.S. Cl.
CPC ..... *F02M 59/46* (2013.01); *F02M 59/466* (2013.01); *F02M 59/368* (2013.01); *F02M 59/462* (2013.01); *F02M 2200/09* (2013.01)

(56) References Cited

U.S. PATENT DOCUMENTS 5,558,068 A * 9/1996 Kunishima ..... F02D 33/006 123/179.17
6,119,655 A * 9/2000 Heinitz ..... F02D 41/20 123/447
6,755,176 B2 * 6/2004 Takeuchi ..... F02D 41/0085 123/299
9,683,512 B2 * 6/2017 Stickler ..... F02M 57/02
2002/0170539 A1 * 11/2002 Rembold ..... F02M 55/04 123/458
2003/0164166 A1 * 9/2003 Takeuchi ..... F02D 41/0085 123/674
2007/0186906 A1 * 8/2007 Mueller ..... F02D 41/3845 123/446
2011/0295493 A1 12/2011 Wilms et al.
2012/0138021 A1 6/2012 Kim et al.
2014/0099215 A1 4/2014 Kawano et al.
2014/0348676 A1 * 11/2014 Kato ..... F04B 1/0452 417/437
2015/0337753 A1 * 11/2015 Stickler ..... F02M 57/02 123/506
2017/0218904 A1 * 8/2017 Koga ..... F02M 59/36

FOREIGN PATENT DOCUMENTS

JP 10141177 A * 5/1998 ..... F02M 59/464
JP 2012-246852 A 12/2012
JP 2012-251447 A 12/2012
JP 2015-17553 A 1/2015
JP 2015-78630 A 4/2015
JP 2015-137578 A 7/2015

OTHER PUBLICATIONS

Japanese-language Written Opinion (PCT/ISA/237) issued in PCT Application No. PCT/JP2016/072466 dated Oct. 11, 2016 (Four (4) pages).
European Search Report issued in counterpart European Application No. 16850858.8 dated Apr. 15, 2019 seven (7) pages.

* cited by examiner

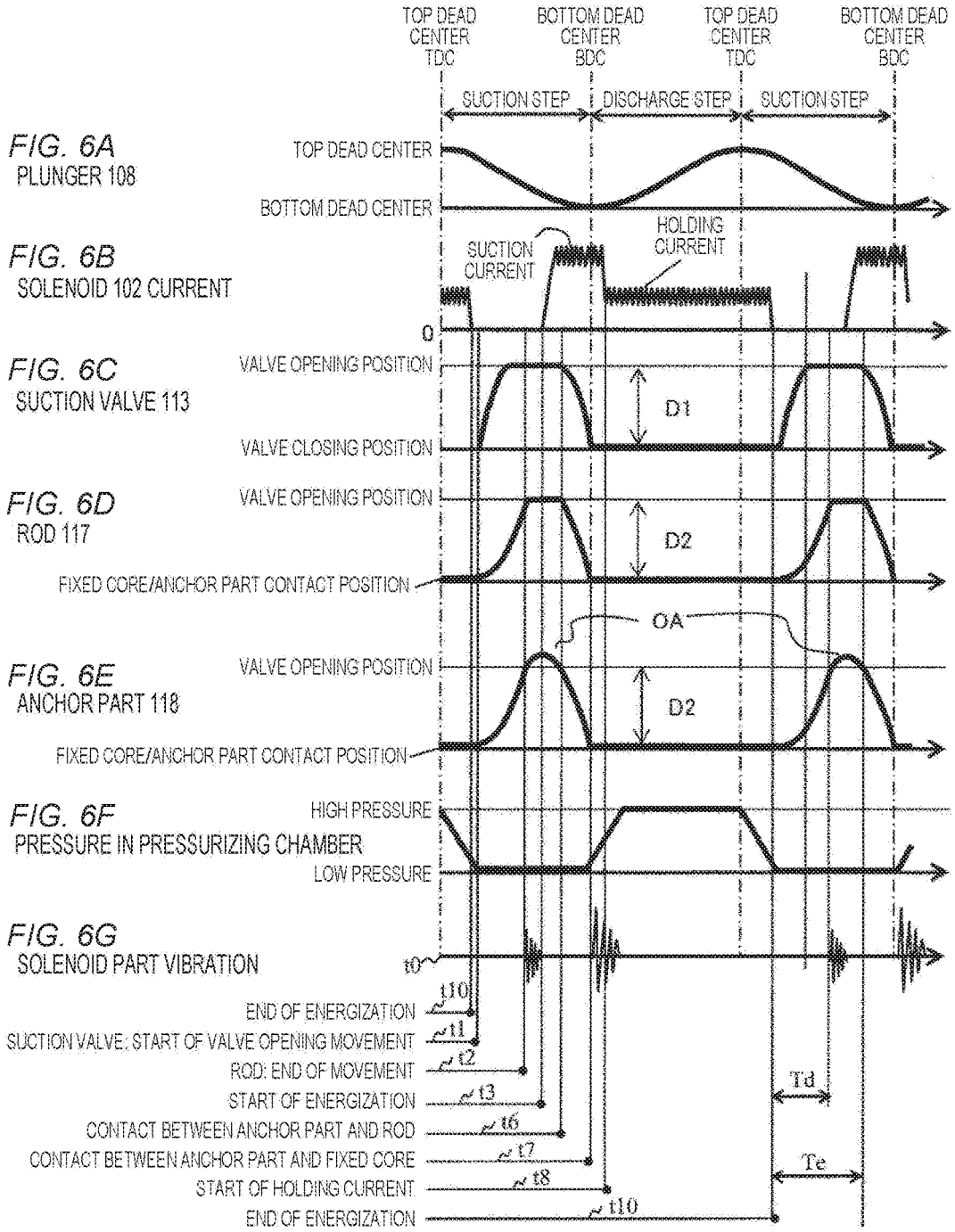
TOP DEAD CENTER TDC
BOTTOM DEAD CENTER BDC
TOP DEAD CENTER TDC
BOTTOM DEAD CENTER BDC
SUCTION STEP
DISCHARGE STEP
SUCTION STEP
FIG. 6A
PLUNGER 108
TOP DEAD CENTER
BOTTOM DEAD CENTER
FIG. 6B
SOLENOID 102 CURRENT
SUCTION CURRENT
HOLDING CURRENT
0
FIG. 6C
SUCTION VALVE 113
VALVE OPENING POSITION
D1
VALVE CLOSING POSITION
FIG. 6D
ROD 117
VALVE OPENING POSITION
D2
FIXED CORE/ANCHOR PART CONTACT POSITION
OA
FIG. 6E
ANCHOR PART 118
VALVE OPENING POSITION
D2
FIXED CORE/ANCHOR PART CONTACT POSITION
FIG. 6F
PRESSURE IN PRESSURIZING CHAMBER
HIGH PRESSURE
LOW PRESSURE
FIG. 6G
SOLENOID PART VIBRATION
t0
t10
END OF ENERGIZATION
t1
SUCTION VALVE: START OF VALVE OPENING MOVEMENT
t2
ROD: END OF MOVEMENT
t3
START OF ENERGIZATION
t6
CONTACT BETWEEN ANCHOR PART AND ROD
t7
CONTACT BETWEEN ANCHOR PART AND FIXED CORE
t8
START OF HOLDING CURRENT
t10
END OF ENERGIZATION
Td
Te

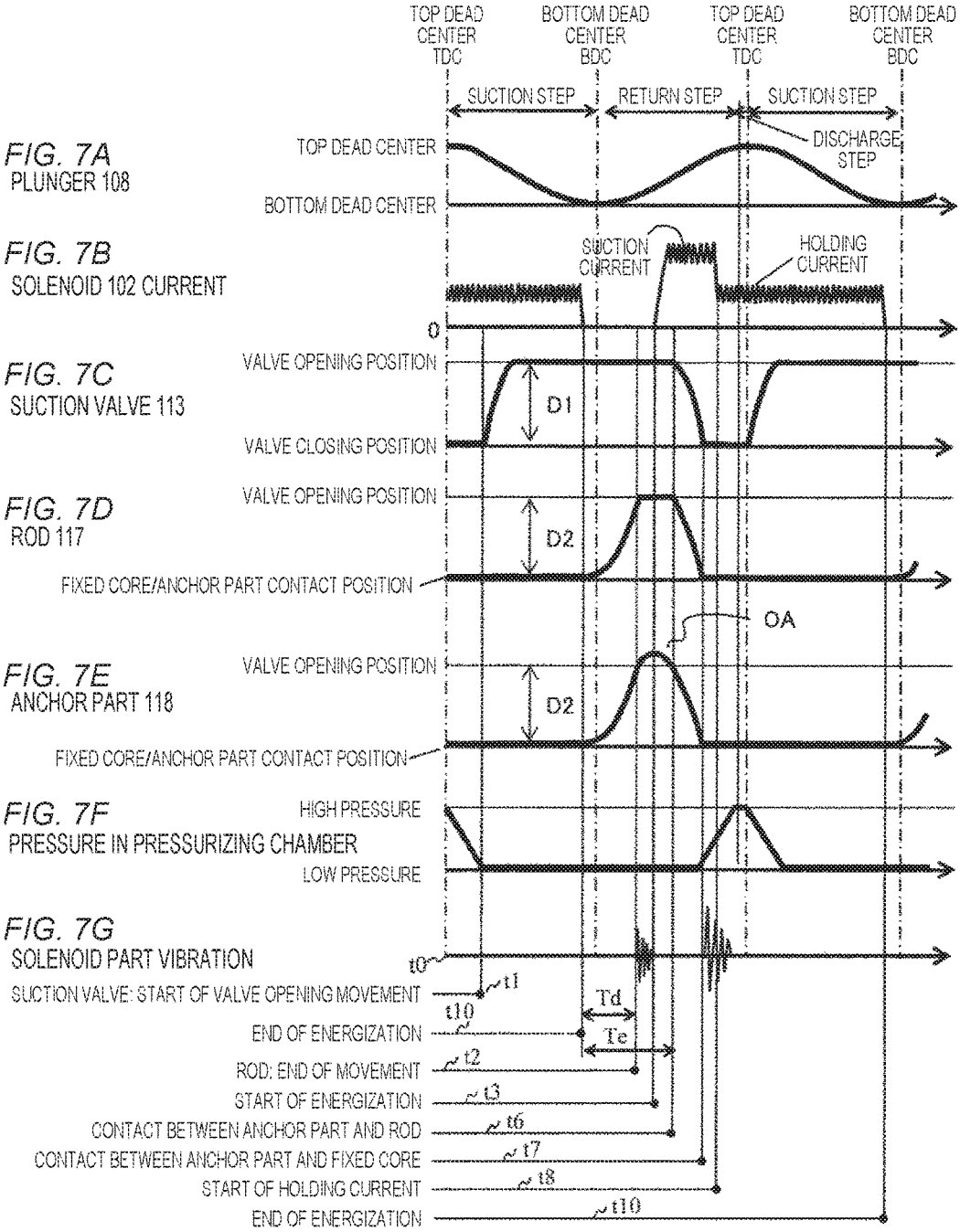
TOP DEAD CENTER TDC
BOTTOM DEAD CENTER BDC
TOP DEAD CENTER TDC
BOTTOM DEAD CENTER BDC
SUCTION STEP
RETURN STEP
SUCTION STEP
DISCHARGE STEP
FIG. 7A
PLUNGER 108
TOP DEAD CENTER
BOTTOM DEAD CENTER
FIG. 7B
SOLENOID 102 CURRENT
SUCTION CURRENT
HOLDING CURRENT
0
FIG. 7C
SUCTION VALVE 113
VALVE OPENING POSITION
D1
VALVE CLOSING POSITION
FIG. 7D
ROD 117
VALVE OPENING POSITION
D2
FIXED CORE/ANCHOR PART CONTACT POSITION
OA
FIG. 7E
ANCHOR PART 118
VALVE OPENING POSITION
D2
FIXED CORE/ANCHOR PART CONTACT POSITION
FIG. 7F
PRESSURE IN PRESSURIZING CHAMBER
HIGH PRESSURE
LOW PRESSURE
FIG. 7G
SOLENOID PART VIBRATION
t0
SUCTION VALVE: START OF VALVE OPENING MOVEMENT
t1
Td
t10
END OF ENERGIZATION
Te
ROD: END OF MOVEMENT
t2
START OF ENERGIZATION
t3
CONTACT BETWEEN ANCHOR PART AND ROD
t6
CONTACT BETWEEN ANCHOR PART AND FIXED CORE
t7
START OF HOLDING CURRENT
t8
END OF ENERGIZATION
t10

HIGH-PRESSURE FUEL PUMP AND CONTROL DEVICE

TECHNICAL FIELD

The present invention relates to a high-pressure fuel pump and a control device.

BACKGROUND ART

In an internal combustion engine of an automobile or the like, in a direct injection type in which fuel is directly injected into a combustion chamber, a high-pressure fuel pump provided with a flow control valve configured to increase the pressure of a fuel and discharge a desired fuel flow rate has been widely used.

With respect to an electromagnetic suction valve provided in a high-pressure fuel supply pump, a technique for reducing a collision sound generated when operated is known (see, for example, PTL 1). PTL 1 discloses "the mass of the colliding member is reduced by the magnetic attraction force and the generated sound is reduced. According to the present invention thus configured, the following effects can be obtained. The sound generated when the core and the anchor collide with each other by the magnetic attraction force depends on the magnitude of the kinetic energy of a movable part. The kinetic energy consumed by the collision is only the kinetic energy of the anchor.

Since the kinetic energy of a rod does not contribute to sound as it is absorbed by the spring, it is possible to reduce the energy when an anchor 31 and a core 33 collide with each other, thereby reducing the generated sound" (see abstract).

CITATION LIST

Patent Literature

PTL 1: JP 2012-251447 A

SUMMARY OF INVENTION

Technical Problem

High-pressure fuel pumps are required to have high pressure or large capacity. When the capacity of the pump is increased, the fluid force acting on a suction valve also increases. Therefore, strengthening of the spring force for holding the suction valve open is required. However, if the spring force is strengthened, the responsiveness of closing the suction valve decreases. In a state where no current is flowing through the solenoid, a high-pressure fuel pump held open by the spring force, that is, a normally open type high-pressure fuel pump, discharges the fuel pressurized in a pressurizing chamber by closing the suction valve at necessary timing.

Here, if the responsiveness of closing the suction valve decreases, it becomes impossible to close the suction valve at a necessary timing. Then, the fuel in the pressurizing chamber returns to a suction side, and the discharge flow rate (discharge efficiency) lowers. In addition, measures may be required to increase the drive current or lengthen the energization time to increase the responsiveness. However, in the technique disclosed in PTL 1, these points are not taken into consideration.

An object of the present invention is to provide a high-pressure fuel pump and a control device capable of maintaining responsiveness of closing a suction valve even when the high-pressure fuel pump is increased in pressure or capacity of the high-pressure fuel pump is increased, thereby ensuring discharge efficiency.

Solution to Problem

In order to achieve the above object, the present invention provides a high-pressure fuel pump including: a rod that urges a suction valve in a valve opening direction; a mover that drives the rod in a valve closing direction; and a solenoid that generates a magnetic attraction force to move the mover in the valve closing direction, wherein the rod reaches a suction valve closing position and then moves in the valve opening direction after the suction valve starts moving from the suction valve closing position in the valve opening direction.

Advantageous Effects of Invention

According to the present invention, responsiveness of closing a suction valve can be maintained even when the high-pressure fuel pump is increased in pressure or capacity of the high-pressure fuel pump is increased, thereby ensuring discharge efficiency. The problems, configurations, and effects other than those described above will be clarified from the description of the embodiments below.

BRIEF DESCRIPTION OF THE DRAWINGS

FIG. 6 is a view FIGS. 6A to 6G are views showing a time chart showing the state of each part in each step in pump operation.

FIG. 7 is a view FIGS. 7A to 7G are views for explaining an operation state of a high-pressure fuel pump according to a second embodiment of the present invention.

DESCRIPTION OF EMBODIMENTS

Figure 1:
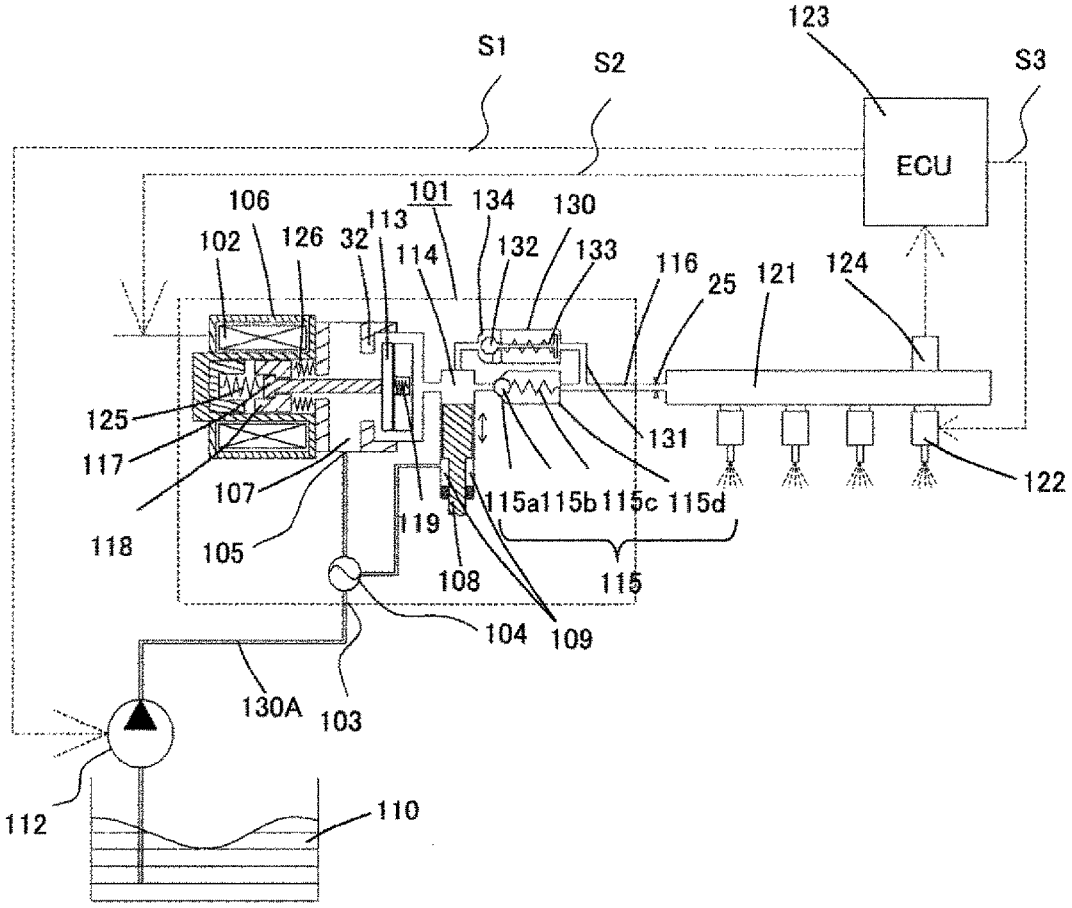
FIG. 1 is a view showing an example of an overall configuration of a fuel supply system including a high-pressure fuel supply pump according to a first embodiment of the present invention.

Hereinafter, the configuration and operation of a high-pressure fuel pump (high-pressure fuel supply pump) according to first and second embodiments of the present invention will be described with reference to the drawings. In each figure, the same reference numerals denote the same parts.

First Embodiment

Figure 2:
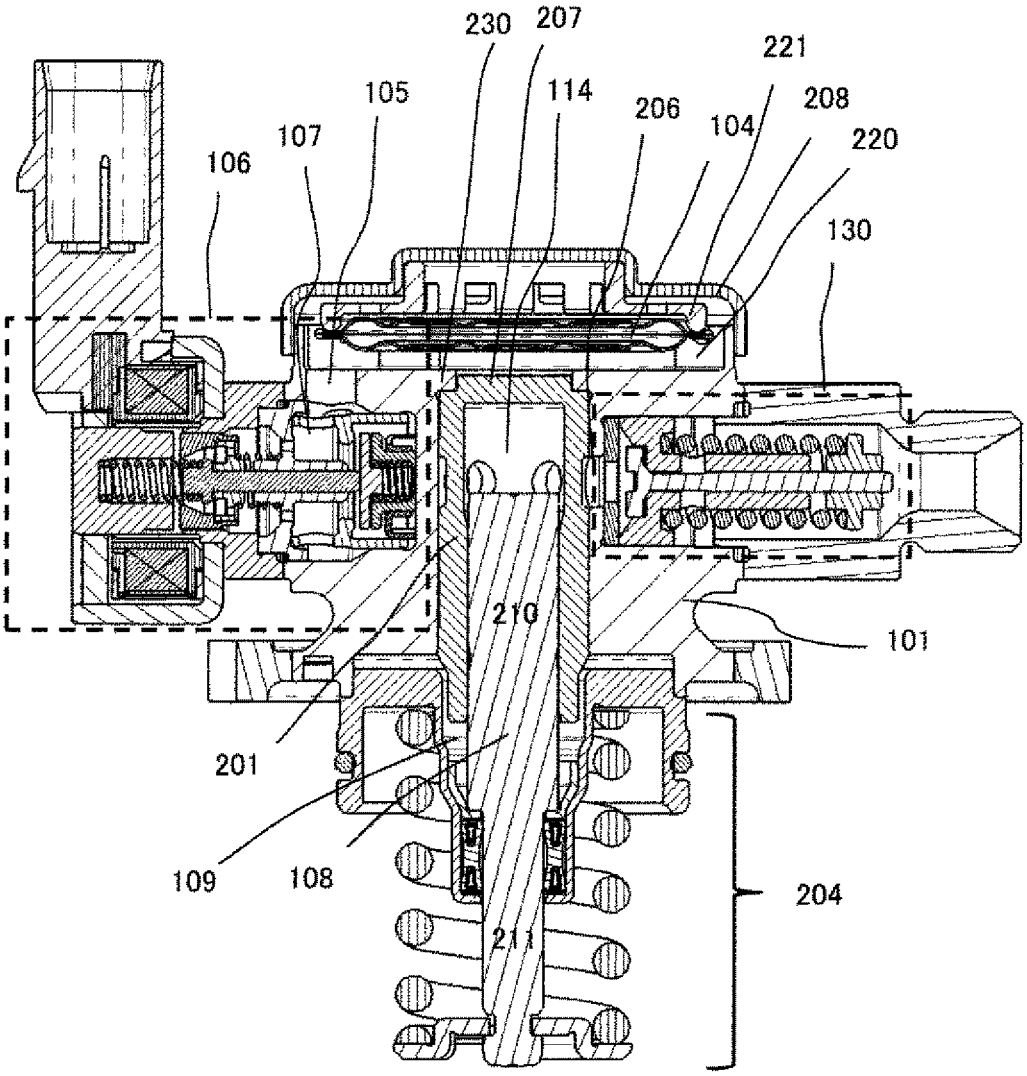
FIG. 2 is a cross-sectional view of the high-pressure fuel supply pump according to the first embodiment of the present invention.

First, a high-pressure fuel pump according to a first embodiment of the present invention will be described with reference to FIGS. 1 to 7. FIG. 1 is a view showing an example of an overall configuration of a fuel supply system including a high-pressure fuel supply pump of the present embodiment. FIG. 2 is a cross-sectional view of the high-pressure fuel pump body in the present embodiment.

In FIG. 1, a part surrounded by a broken line indicates a pump body 101 (high-pressure fuel supply pump body), and the mechanism and parts shown in this broken line are integrated with the pump body 101. Fuel is fed into the pump body 101 from a fuel tank 110 via a feed pump 112, and the pressurized fuel is sent to a fuel injection device 122 (injector) from the pump body 101 through a common rail 121. The engine control unit 123 (ECU) as a control device takes in the pressure of the fuel from a pressure sensor 124, and in order to optimize the pressure, controls the feed pump 112, a solenoid 102 (electromagnetic coil) in the pump body 101, and the fuel injection device 122.

In FIG. 1, the fuel in the fuel tank 110 is pumped up by the feed pump 112 based on the control signal 51 from the engine control unit 123, pressurized to an appropriate feed pressure, and sent to a low-pressure fuel suction port 103 (suction joint) of the pump body 101 through a fuel pipe 130A. The fuel having passed through the low-pressure fuel suction port 103 reaches a suction port 107 of a flow control valve 106 constituting a capacity variable mechanism via a pressure pulsation reduction mechanism 104 and a suction passage 105.

Note that by communicating with an annular low pressure fuel chamber 109, which makes the pressure variable in conjunction with a plunger 108 performing a reciprocating motion by a cam mechanism (not shown) of the engine, the pressure pulsation reduction mechanism 104 reduces the pulsation of the fuel pressure sucked into the suction port 107 of the flow control valve 106.

Fuel flowing into the suction port 107 of the flow control valve 106 passes through the suction valve 113 and flows into a pressurizing chamber 114. The valve position of the suction valve 113 is determined by controlling the solenoid 102 in the pump body 101 based on the control signal S2 from the engine control unit 123. In the pressurizing chamber 114, a driving force reciprocating to the plunger 108 is given by a cam mechanism (not shown) of the engine. Due to the reciprocating motion of the plunger 108, in a lowering step of the plunger 108, the fuel is sucked from the suction valve 113, in a rising step of the plunger 108, the sucked fuel is pressurized, and fuel is pumped through a discharge valve mechanism 115 to the common rail 121 on which the pressure sensor 124 is mounted. Thereafter, the fuel injection device 122 injects fuel to the engine based on a control signal S3 from the engine control unit 123.

The discharge valve mechanism 115 provided at an outlet of the pressurizing chamber 114 includes a discharge valve seat 115*a*, a discharge valve 115*b* that comes into contact with and separates from the discharge valve seat 115*a*, a discharge valve spring 115*c* that urges the discharge valve 115*b* toward the discharge valve seat 115*a*, a discharge valve holder 115*d* that houses the discharge valve 115*b* and the discharge valve seat 115*a*, and the like. The discharge valve seat 115*a* and the discharge valve holder 115*d* are joined by welding at a contact part (not shown) to form the integral discharge valve mechanism 115.

The discharge valve 115*b* is opened when the internal pressure of the pressurizing chamber 114 is higher than the pressure on a discharge passage 116 side on the downstream side of the discharge valve 115*b* and overcomes drag force determined by the discharge valve spring 115*c*, and the fuel pressurized from the pressurizing chamber 114 to the discharge passage 116 side is fed under pressure.

Figure 4:
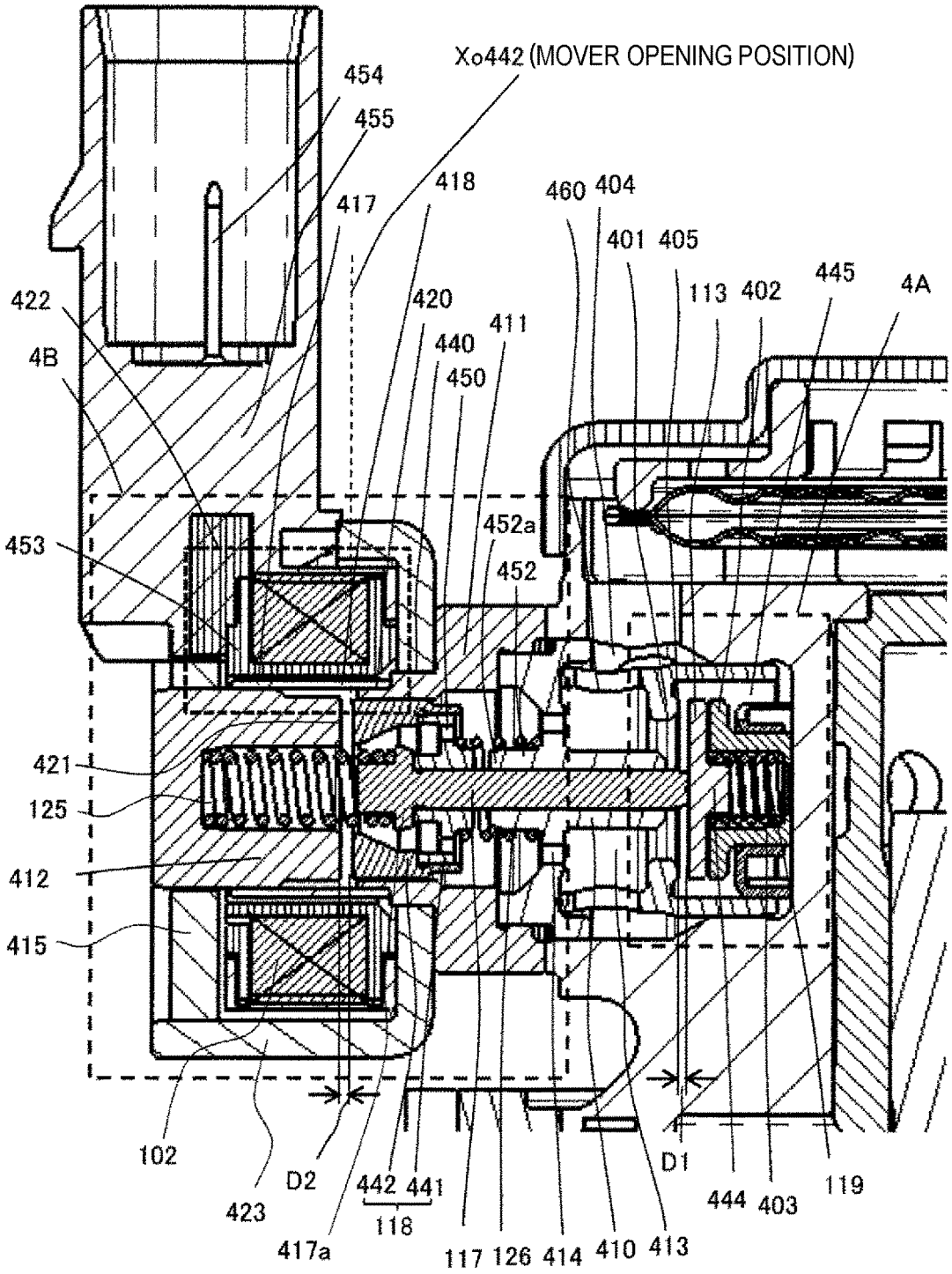
FIG. 4 is a cross-sectional enlarged view of a flow control valve of the high-pressure fuel supply pump body in the first embodiment.

Further, as shown in FIG. 4, the flow control valve 106 shown in FIG. 1 includes the suction valve 113, a rod 117 (rod part) that controls the position of the suction valve 113, a mover 442 (movable part), an anchor sliding part 441 fixed to an anchor part 118 and sliding with the rod 117, a suction valve spring 119, a urging spring 125 that urges the rod toward the suction valve 113, and an anchor part urging spring 126.

The suction valve 113 is urged in the valve closing direction by the suction valve spring 119 and urged in the valve opening direction via the rod 117 by a rod urging spring 125. In addition, the mover 442 is urged in the valve closing direction by the anchor part urging spring 126. The valve position of the suction valve 113 is controlled by driving the rod 117 by the solenoid 102. In the following description, a component formed integrally with the mover 442 and the anchor sliding part 441 is referred to as the anchor part 118.

In this manner, as shown in FIG. 1, in the high-pressure fuel supply pump, the solenoid 102 in the pump body 101 is controlled by the control signal S2 which the engine control unit 123 gives to the flow control valve 106, and the high-pressure fuel supply pump discharges the fuel flow rate so that the fuel pumped to the common rail 121 via the discharge valve mechanism 115 becomes a desired supply fuel.

Further, in the high-pressure fuel supply pump, the pressurizing chamber 114 and the common rail 121 are communicated with each other by a relief valve 130. The relief valve 130 is a valve mechanism arranged in parallel with the discharge valve mechanism 115. When the pressure on the side of the common rail 121 increases above the set pressure of the relief valve 130, the relief valve 130 opens and fuel is returned into the pressurizing chamber 114 of the pump body 101, thereby preventing an abnormal high pressure state in the common rail 121.

The relief valve 130 is provided so that a high pressure flow path 131 that communicates the discharge passage 116 on the downstream side of the discharge valve 115*b* in the pump body 101 with the pressurizing chamber 114 is formed and the discharge valve 115*b* is bypassed. The high pressure flow path 131 is provided with a valve body 132 that limits the flow of fuel from the discharge passage 116 to the pressurizing chamber 114 in only one direction. The valve body 132 is pressed against a relief valve seat 134 by a relief spring 133 which generates a pressing force, and is configured so that when a pressure difference between the inside of the pressurizing chamber 114 and the inside of the high pressure flow path 131 becomes equal to or higher than the specified pressure determined by the relief spring 133, the relief valve 130 separates from the relief valve seat 134 and opens.

As a result, the common rail 121 becomes abnormally high pressure due to failure of the flow control valve 106 of the pump body 101 or the like. In this case, when a differential pressure between the discharge passage 116 and the pressurizing chamber 114 becomes equal to or higher than a valve opening pressure of the valve body 132, the relief valve 130 opens. The fuel having become abnormally high pressure is returned from the discharge passage 116 to the pressurizing chamber 114 so as to protect the high-pressure pipe such as the common rail 121.

FIG. 2 is a view showing a specific example of the high-pressure fuel supply pump integrally structured mechanically.

In FIG. 2, the plunger 108 that performs reciprocating movement (in this case, vertical movement) by a cam mechanism (not shown) of the engine is arranged in a cylinder 201 in the center height direction in FIG. 2, and the pressurizing chamber 114 is formed in the cylinder 201 above the plunger 108.

Figure 3:
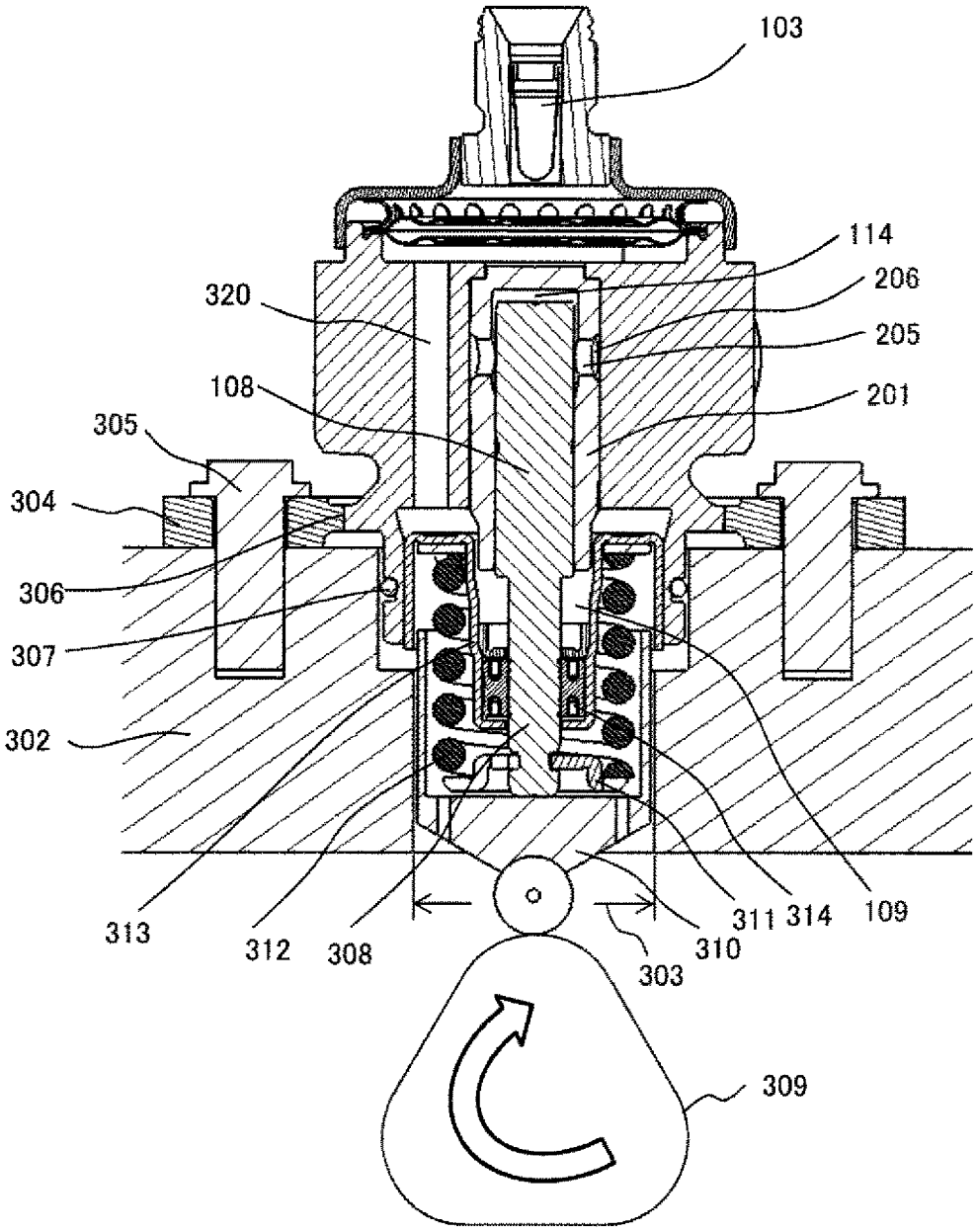
FIG. 3 is a view showing a state in which an attachment root used in the high-pressure fuel supply pump according to the first embodiment of the present invention is attached to an internal combustion engine body and fixed.

Further, a mechanism on the flow control valve 106 side is arranged on the center left side of in FIG. 2, and a mechanism of the relief valve 130 is arranged on the center right side in FIG. 2. In addition, in the upper part in FIG. 2, the low-pressure fuel suction port (not shown), the pressure pulsation reduction mechanism 104, the suction passage 105, and the like are arranged as a mechanism on the fuel suction side. Further, an attachment root 204 (plunger internal combustion engine side mechanism) is described in the center lower part of FIG. 2. As shown in FIG. 3, the attachment root 204 is a part embedded and fixed in the internal combustion engine body.

Note that in a display section in FIG. 2, the low-pressure fuel suction port is not shown. The low-pressure fuel suction port can be displayed within the display section of another angle. More specifically, the low-pressure fuel suction port 103 is provided on the circumference around the cylinder 201 as an axis.

FIG. 3 shows a state in which the attachment root 204 is embedded in the internal combustion engine body and fixed. However, in FIG. 3, the attachment root 204 is described as the center, so that description of the other parts is omitted. In FIG. 3, the low-pressure fuel suction port 103 is located at the upper part of the fuel pump body.

In FIG. 3, reference numeral 302 denotes a thick portion of the cylinder head of the internal combustion engine. In a cylinder head 302 of the internal combustion engine, an attachment root attachment hole 303 having a two-step diameter is formed in accordance with the shape of the attachment root 204. The attachment root 204 is fitted into the attachment root attachment hole 303, whereby the attachment root 204 is airtightly fixed to the cylinder head 302 of the internal combustion engine.

In FIG. 3, the high-pressure fuel supply pump closely contacts a plane of the cylinder head 302 using a flange 304 provided in the pump body 101 and is fixed by at least two or more bolts 305. The attachment flange 304 is welded and joined to the pump body 101 at a welding part 306 with a laser to form an annular fixing part. In order to seal between the cylinder head 302 and the pump body 101, an O-ring 307 is fitted into the pump body 101 to prevent the engine oil from leaking to the outside. Note that the flange 304 and the pump body 101 may be integrally molded.

The attachment root 204 is provided with, at a lower end 308 of the plunger 108, a tappet 310 that converts the rotational motion of a cam 309 attached to the camshaft of the internal combustion engine to vertical motion and transmitting the converted motion to the plunger 108. The plunger 108 is pressed against the tappet 310 by a spring 312 via a retainer 311. As a result, the plunger 108 reciprocates up and down in accordance with the rotational motion of the cam 309.

A plunger seal 314 held at a lower end part of the inner circumference of a seal holder 313 is installed in a state of slidably contacting the outer circumference of the plunger 108 at the lower part of the cylinder 201 in FIG. 3. Even when the fuel in the annular low pressure fuel chamber 109 slides on the plunger 108, a sealable structure can be attained so as to prevent fuel from leaking to the outside.

In FIG. 2, the cylinder 201 having an end part (upper side in FIG. 2) formed in a bottomed tubular shape is attached to the pump body 101 so as to guide the reciprocating motion of the plunger 108 and form the pressurizing chamber 114 therein. Furthermore, a plurality of communication holes 205 (see FIG. 3) communicating the annular groove 206 with an annular groove 206 and the pressurizing chamber 114 are provided on the outer circumferential side so as to communicate with the discharge valve mechanism 115 for discharging fuel from the flow control valve 106 and the pressurizing chamber 114 to the discharge passage.

The cylinder 201 is fixed, at the outer diameter thereof, by being press-fitted to the pump body 101, and the cylinder 201 seals the pressurized part cylindrical surface so that fuel pressurized from the gap with the pump body 101 does not leak to the low pressure side. A small diameter part 207 is provided on the outside diameter of the cylinder 201 on the pressurizing chamber 114 side. As the fuel in the pressurizing chamber 114 is pressurized, a force acts on a low pressure fuel chamber 220 side of the cylinder 201. However, by providing a small diameter part 230 in the pump body 101, it is possible to prevent the cylinder 201 from coming off to the low pressure fuel chamber 220 side. By bringing each other's surface into contact with a plane in the axial direction, in addition to the seal of the contact cylindrical surface between the pump body 101 and the cylinder 201, a function as a double seal can be attained.

A damper cover 208 is fixed to the head portion of the pump body 101. Furthermore, the low-pressure fuel suction port 103 (see FIG. 3) is provided on the low pressure fuel chamber 220 side of the pump body 101. The fuel having passed through the low-pressure fuel suction port passes through a filter (not shown) fixed inside the low pressure fuel suction port, and reaches the suction port 107 of the flow control valve 106 via the pressure pulsation reduction mechanism 104 and the suction passage 105.

Since the plunger 108 has a large diameter part 210 and a small diameter part 211, the volume of the annular low pressure fuel chamber 109 is increased or decreased by the reciprocating motion of the plunger 108. Regarding increase and decrease in volume, by communicating with the low pressure fuel chamber 220 by the fuel passage 320 (FIG. 3), when the plunger 108 descends, a flow of fuel is generated from the annular low pressure fuel chamber 109 to the low pressure fuel chamber 220, and when the plunger 108 rises, a flow of fuel is generated from the low pressure fuel chamber 220 to the annular low pressure fuel chamber 109. This makes it possible to reduce the fuel flow rate to the inside and outside of the pump during a pump suction step or return step, and has a function of reducing pulsation.

As shown in FIG. 2, the pressure pulsation reduction mechanism 104 is installed in the low pressure fuel chamber 220 to reduce the pressure pulsation generated in the high-pressure fuel supply pump from spreading to the fuel pipe 130A (FIG. 1). When the fuel flowing into the pressurizing chamber 114 is returned to the suction passage 105 (suction port 107) through the suction valve 113 which is in the valve opening state for the capacity control, pressure pulsation occurs in the low pressure fuel chamber 220 due to the fuel returned to the suction passage 105 (suction port 107). The pressure pulsation reduction mechanism 104 is formed of a metal damper in which two sheet-shaped disc-shaped metal plates are bonded together at the outer circumference thereof and an inert gas such as argon is injected into the inside thereof, and pressure pulsation is reduced by absorption and contraction of this metal damper. Reference numeral 221 denotes a mounting bracket for fixing the metal damper to the pump body 101.

In FIG. 2, in a state where there is no fuel pressure difference between the pressurizing chamber 114 and a fuel discharge port of the discharge valve mechanism 115 (see FIG. 1), the discharge valve 115*b* is pressed against the discharge valve seat 115*a* by the urging force of the discharge valve spring 115*c*, and is in a valve closing state. Only when the fuel pressure in the pressurizing chamber 114 becomes larger than the fuel pressure at the fuel discharge port, the discharge valve 115*b* opens against the discharge valve spring 115*c*, and the fuel in the pressurizing chamber 114 is discharged to the common rail 121 at a high pressure via the fuel discharge port. When the discharge valve 115*b* opens, the discharge valve 115*b* comes into contact with a discharge valve stopper, and the stroke is restricted. Therefore, the stroke of the discharge valve 115*b* is appropriately determined by the discharge valve stopper. As a result, the stroke is so large that the fuel discharged to the fuel discharge port at a high pressure can be prevented from flowing back into the pressurizing chamber 114 again due to the closing delay of the discharge valve 115*b*, thereby suppressing decrease in efficiency of the high-pressure fuel supply pump.

Figure 5:
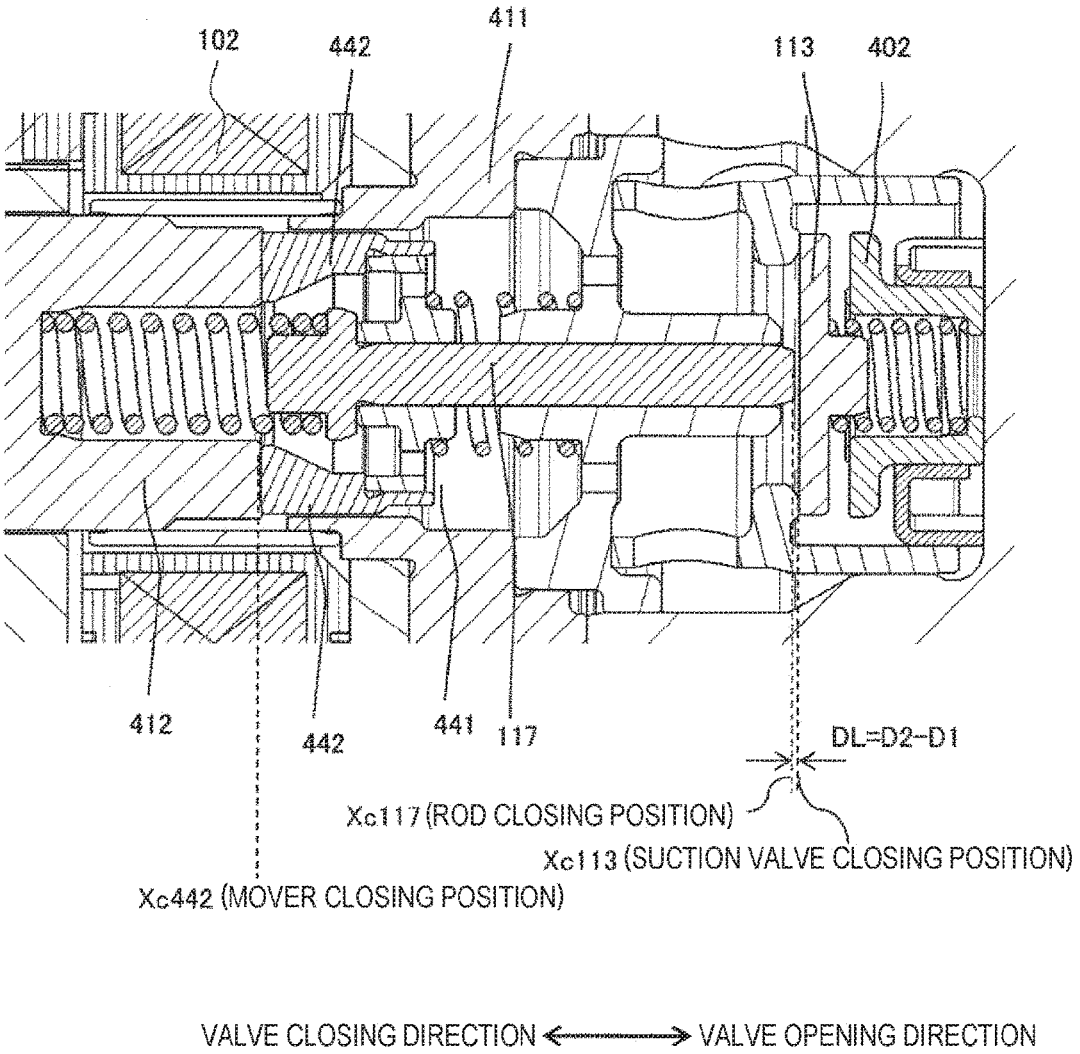
FIG. 5 is a cross-sectional enlarged view of the flow control valve in the first embodiment and shows a state in which the suction valve is closed in a discharge step and an anchor part and a fixed core are in contact with each other.

Next, the structure of the flow control valve 106 side, which is the main part of the present embodiment, will be described with reference to FIGS. 4 and 5. FIG. 4 shows a state in a suction step among the steps of suction, return, and discharge in pump operation, and FIG. 5 shows a state in the discharge step. First, the structure of the flow control valve 106 side will be described with reference to FIG. 4. The structure on the flow control valve 106 side is described by being roughly divided into a suction valve part 4A including mainly the suction valve 113, and a solenoid mechanism part 4B including mainly the rod 117, the mover 442, and the solenoid 102.

First, the suction valve part 4A includes the suction valve 113, a suction valve seat 401, a suction valve stopper 402, a suction valve urging spring 119, and a suction valve holder 403. The suction valve seat 401 is cylindrical, includes a seat part 405 in and inner peripheral side axial direction, and two or more suction passages 404 radially around the axis of the cylinder, and is joined to the pump body 101 by an outer peripheral cylindrical surface by press fitting and held.

The suction valve holder 403 has radial claws in two or more directions, and the outer circumferential side of the claw is coaxially fitted and held on the inner peripheral side of the suction valve seat 401. Further, a suction valve stopper 402 having a cylindrical shape and having a flange shape at one end portion is joined to an inner peripheral cylindrical surface of the suction valve holder 403 by press fitting and held.

The suction valve urging spring 119 is arranged on the inner peripheral side of the suction valve stopper 402 at a small diameter portion for partially coaxially stabilizing one end of the spring, and the suction valve 113 is configured so that the suction valve urging spring 119 is fitted in a valve guide part 444 between the seat part 405 and the suction valve stopper 402. The suction valve urging spring 119 is a compression coil spring and is installed so that an urging force acts in a direction in which the suction valve 113 is pressed against the seat part 405. The present invention is not limited to the compression coil spring, and any form may be used as long as it is capable of obtaining the urging force, and it may be a leaf spring having an urging force integrated with the suction valve 113.

By configuring the suction valve part 4A in this way, in the pump suction step, a fuel that has passed through the suction passage 404 and entered into the flow control valve passes between the suction valve 113 and the seat part 405, passes between the outer circumferential side of the suction valve 113 and the fuel passage 445 provided at the outer diameter of the suction valve stopper 402, passes through the passage of the pump body 101 and the cylinder, and is caused to flow into the pressurizing chamber.

In the discharge step of the pump, the suction valve 113 comes into contact with the seat part 405 and seals the fuel, thereby performing the function of a check valve preventing back flow to the suction port side of the fuel.

An axial movement amount D1 of the suction valve 113 is restricted to a finite extent by the suction valve stopper 402. If the movement amount is too large, the backflow amount increases due to the response delay when the suction valve 113 closes, and the performance of the pump deteriorates. The regulation of the amount of movement can be defined by the axial dimension and the press-fitting position of the suction valve seat 401, the suction valve 113, and the suction valve stopper 402.

The suction valve stopper 402 is provided with an annular protrusion to reduce the contact area with the suction valve stopper 402 in a state where the suction valve 113 opens. This is to improve the valve closing responsiveness so that the suction valve 113 is easily separated from the suction valve stopper 402 at the transition from the valve opening state to the valve closing state. In the absence of the annular protrusion, that is, in a case where the contact area is large, when the suction valve 113 and the suction valve stopper 402 are separated from each other, the pressure between the suction valve 113 and the suction valve stopper 402 decreases and a squeezing force acts in a direction hindering the movement of the suction valve 113, making it difficult for the suction valve 113 to separate from the suction valve stopper 402.

Since the suction valve 113, the suction valve seat 401, and the suction valve stopper 402 repeat the collision at the time of mutual operation, a material that has been subjected to heat treatment for martensitic stainless steel that has high strength, high hardness and also excellent corrosion resistance may be used. For the suction valve spring 119 and the suction valve holder 403, an austenitic stainless steel material is preferably used in consideration of corrosion resistance.

Next, the solenoid mechanism part 4B will be described. The solenoid mechanism part 4B includes: the rod 117 and the mover 442, each of which is a movable element; a guide part 410, an outer core 411, and a fixed core 412, each of which is a fixed part; the rod urging spring 125; the anchor part urging spring 126; the cover part 415; a yoke 423; and the solenoid 102.

The rod 117 that is a movable element and the anchor part 118 are formed as separate members. The rod 117 is held slidably in the axial direction on the inner peripheral side of the guide part 410, and the inner peripheral side of the anchor sliding part 441 of the mover 442 is held slidably on the outer circumferential side of the rod 117. That is, both the rod 117 and the anchor part 118 are configured to be slidable in the axial direction within a range geometrically restricted. The anchor sliding part 441 is configured to contact a flange part 417*a* of the rod 117 at the end face on the fixed core 412 side.

Since the anchor part 118 moves freely and smoothly in the fuel in the axial direction, and one or more through holes 450 penetrating through the anchor sliding part 441 in a component axial direction. Further, the through hole 450 may be provided at the center of the rod 117, a fuel passage of a lateral groove may be provided on the suction valve 113 side of the guide part 410 so as to be substantially parallel to the suction passage 404, and a space on the fixed core 412 side of the anchor part 118 and a space 413 on the upstream side of the suction valve seat 401 may be made to communicate with each other.

The guide part 410 is radially inserted into the inner peripheral side of the hole into which the suction valve 113 of the pump body 101 is inserted, abuts against one end portion of the suction valve seat 401 in the axial direction, and is arranged to be sandwiched between the outer core 411 welded and fixed to the pump body 101 and the pump body 101 Similarly to the anchor part 118, the guide part 410 is also provided with a fuel passage 414 penetrating in the axial direction.

The outer core 411 has a thin-walled cylindrical shape on the side opposite to the portion to be welded to the pump body 101, and is joined and fixed by welding in such a manner that the fixed core 412 is inserted into the inner periphery side. The rod urging spring 125 is arranged on the inner peripheral side of the fixed core 412 with the small diameter portion as a guide, the rod 117 comes into contact with the suction valve 113, and the suction valve 113 applies an urging force in a direction to separate from the suction valve seat 401, that is, in a valve opening direction of the suction valve 113.

The anchor part urging spring 126 is arranged such that one end is inserted into a central bearing part 452 having a cylindrical diameter provided on the center side of the guide part 410 and an urging force in the direction of a rod flange part 417*a* is applied to the anchor part 118 while maintaining the same axis. The movement amount D2 of the anchor part 118 is set to be larger than the movement amount D1 of the suction valve 113. By bringing the suction valve 113 and the suction valve seat 401 into contact with each other before the anchor part 118 and the fixed core 412 come into contact with each other when the suction valve 113 is closed from the valve opening state, the suction valve 113 is surely closed and the responsiveness at the time of closing the suction valve 113 can be ensured. As a result, the discharge flow rate can be ensured.

Further, an excluded volume due to the movement of the anchor part 118 at the time of valve closing flows between the anchor part 118 and the fixed core 412, so that the pressure between the anchor part 118 and the fixed core 412 increases. As the pressure increases, fluid force, so-called squeeze force acts on the anchor part 118 and is pushed in the opposite direction to the valve closing direction. The squeeze force is generally proportional to the cube of a gap between the anchor part 118 and the fixed core 412, so that the smaller the gap, the greater the influence.

The suction valve 113 is closed before the squeeze force acting on the anchor portion is increased by increasing the movement amount of the anchor part 118 relative to the movement amount D1 of the suction valve 113, so that there is an effect of suppressing the decrease in the discharge flow rate caused by the decrease in responsiveness of the suction valve 113.

Since the rod 117 and the guide part 410 slide on each other and the rod 117 repeatedly collides with the suction valve 113, the rod 117 uses heat treated martensitic stainless steel in consideration of hardness and corrosion resistance. The anchor part 118 and the fixed core 412 use ferrite magnetic stainless steel in order to form a magnetic circuit, and austenitic stainless steel may be used for the rod urging spring 125 and the anchor part urging spring 126 in consideration of corrosion resistance.

According to the above configuration, three springs are arranged in an organic manner in the suction valve part 4A and the solenoid mechanism part 4B. The suction valve urging spring 119 configured in the suction valve part 4A, the rod urging spring 125 configured in the solenoid mechanism part 4B, and the anchor part urging spring 126 correspond to the three springs. In this embodiment, any of the springs uses a coil spring, but any configuration can be adopted as long as it provides an urging force.

The relationship between these three spring forces is constructed by the following equation.

$$F125>F126+F119+F113 \quad (1)$$

Here, F125 is a force of the rod urging spring 125, F126 is a force of the anchor part urging spring 126, F119 is a force of the suction valve urging spring 119, and F113 is a force that the suction valve 113 tries to close by the fluid.

When no electric current is supplied to the solenoid 102, due to each spring force, the rod 117 acts as a force f1 in a direction to separate the suction valve 113 from the seat part 405, that is, in a direction in which the valve opens, from the relationship of equation (1). From equation (1), the force f1 in the valve opening direction is expressed by the following equation (2).

$$f1=F125-(F126+F119+F113) \quad (2)$$

Here, F113 is a force which changes according to the pump flow rate. In a pump having a large capacity, since the fluid force is large, the force of the rod urging spring 125 also increases.

Next, the configuration of the solenoid part around the solenoid 102 of the solenoid mechanism part 4B will be described. The solenoid portion includes the cover part 415, the yoke 423, the solenoid 102, a bobbin 453, a terminal 454, and a connector 455. A solenoid 102 in which a copper wire is wound a plurality of times on the bobbin 453 is arranged so as to be surrounded by the cover part 415 and the yoke 423, and is molded and fixed integrally with the connector which is a resin member. One end of each of the two terminals 454 is connected to both ends of the copper wire of the solenoid 102 in a conductible state. Similarly, the terminal 454 is integrally molded with the connector 455, and the remaining one end thereof can be connected to the engine control unit side.

A seal ring 418 is provided on the side of the solenoid 102 in the radial direction of the outer diameter of the fixed core 412. The seal ring 418 is fixed by being press-fitted to an outer diameter part 417 of the fixed core 412 and an outer diameter part 420 of the outer core 411, and the fuel is sealed by welding the vicinity of a press-fit fixing part. The seal ring 418 is provided on the outer diameter side opposed to a suction surface 421 of the fixed core 412 in the radial direction. Furthermore, a small diameter part 440 of the yoke 423 is press-fitted and fixed to the outer core 411. At that time, the inner diameter side of the cover part 415 comes into contact with the fixed core 412 or comes close to the fixed core 412 with a slight clearance.

Both of the cover part 415 and the yoke 423 are made of a magnetic stainless steel material in order to construct a magnetic circuit and in consideration of corrosion resistance, and the bobbin 453 and the connector 455 use a high-strength heat-resistant resin in consideration of strength characteristics and heat resistance characteristics. The solenoid 102 is made of copper, and the terminal 454 is made of metal plated brass.

By configuring the solenoid mechanism part 4B as described above, as indicated by a broken line 422 in FIG.

4, when a magnetic circuit is formed by the anchor part 118, the fixed core 412, the cover part 415, the yoke 423, and the outer core 411 and a current is supplied to the solenoid 102, a magnetic attraction force is generated between the fixed core 412 and the anchor part 118, and a force for pulling the anchor part 118 toward the fixed core 412 is generated.

By configuring the material of the seal ring 418 to use austenitic stainless steel, a magnetic flux easily passes between the fixed core 412 and the anchor part 118, and the magnetic attraction force can be improved. Furthermore, when the seal ring 418 is formed integrally with the outer core 411, the magnetic flux flowing on the side of the outer core 411 can be reduced by minimizing the portion located at the outer diameter in the radial direction of the suction surface 421 as much as possible. As a result, the magnetic flux passing between the fixed core 412 and the anchor part 118 increases, and the magnetic attraction force can be improved.

When the above magnetic attraction force exceeds the force f1 in the direction in which the valve in the equation (2) opens, the anchor part 118 that is a movable element is drawn to the fixed core 412 together with the rod 117, and the anchor part 118 continues to move until the anchor part 118 makes contact with the fixed core 412.

In accordance with the above configuration of the high-pressure fuel supply pump according to the embodiment of the present invention, in each step of suction, return, and discharge in pump operation, the pump operates as follows.

First, the suction step will be described. In the suction step, the plunger 108 moves in the direction toward the cam 309 (the plunger 108 descends) by the rotation of the cam 309 in FIG. 3. That is, the position of the plunger 108 moves from the top dead center to the bottom dead center. In the suction step state, for example, referring to FIGS. 1, 2 and 3, the volume of the pressurizing chamber 114 increases and the fuel pressure in the pressurizing chamber 114 decreases. When the fuel pressure in the pressurizing chamber 114 becomes lower than the pressure in the suction passage 105 (FIG. 1) in this step, the suction valve 113 opens. The fuel passes through the communication hole 205 provided in the pump body 101 and the groove 206 (cylinder outer peripheral passage), and flows into the pressurizing chamber 114.

The positional relationship of each part on the flow control valve 106 side in the suction step will be described with reference to FIG. 4. In this state, the solenoid 102 is in a non-energized state and no magnetic attraction force acts. Therefore, the rod 117 is urged to the right-hand method in response to the urging force of the rod urging spring 125. The suction valve 113 is urged to the right in the drawing by the front-rear differential pressure and the urging force of the rod 117, and opens to a position where the suction valve 113 comes into contact with the suction valve stopper 402.

At this time, the anchor part 118 engages with the rod 117 and moves to the right in FIG. 4. Since there is a clearance up to the portion that regulates the moving distance (the end surface portion 452*a* of the guide part 452), the anchor part 118 can slightly overshoot. However, the anchor part 118 is returned to the position where the anchor part 118 engages with the rod 117 by the urging force of the anchor part urging spring 126. FIG. 4 shows a state immediately before overshoot.

Next, a return step will be described. In the return step, the rotation of the cam 309 in FIG. 3 moves the plunger 108 in the upward direction. That is, the position of the plunger 108 moves from a bottom dead center to a top dead center. At this time, the volume of the pressurizing chamber 114 decreases with the compression motion after suction in the plunger 108. However, in this state, the fuel once suctioned into the pressurizing chamber 114 is returned to the suction passage 404 again through the suction valve 113 in the valve opening state, so that the pressure of the pressurizing chamber 114 never increases. This step is referred to as the return step.

Next, from this state, when a control signal from the engine control unit 123 is applied to the flow control valve 106, the return step shifts to the discharge step. When the control signal is applied to the flow control valve 106, a magnetic flux is generated in the magnetic circuit, and a magnetic attraction force is generated in the anchor part 118. The positional relationship of each part on the flow control valve 106 side when the magnetic attraction force acts is shown in FIG. 5 and will be explained with reference to FIG. 5.

In this state, a current is applied to the solenoid 102, magnetic flux passes between the fixed core 412 and the anchor part 118, a magnetic attraction force is generated in the anchor part 118, and the anchor part 118 is drawn to the fixed core 412 side. The rod 117 engages with the anchor part 118 at the rod flange part 417*a* and is urged to the left in FIG. 5 together with the anchor part 118. Since an opening valve urging force by the rod 117 does not work, the suction valve 113 is closed by the urging force of the suction valve urging spring 119 and the fluid force caused by the fuel flowing into the suction passage 404. After closing the valve, when the fuel pressure in the pressurizing chamber 114 rises together with the ascending motion of the plunger 108 and the fuel pressure reaches or exceeds the pressure of the fuel discharge port of the discharge valve mechanism 115, the fuel is discharged via the discharge valve mechanism 115 at a high pressure and is supplied to the common rail 121. This step is referred to as the discharge step.

A compression step (rising step from a lower starting point to an upper starting point) of the plunger 108 includes the return step and the discharge step. By controlling the energization timing of the flow control valve 106 to the solenoid 102, the amount of high-pressure fuel to be discharged can be controlled. If the timing of energizing the solenoid 102 is advanced, the proportion of the return step during the compression step is small and the proportion of the discharge step is large. That is, the amount of fuel returned to the suction passage 404 is small, and the amount of fuel discharged at a high pressure is increased. On the other hand, if the timing of energizing the solenoid 102 is delayed, the proportion of the return step during the compression step is large and the proportion of the discharge step is small. That is, the amount of fuel returned to the suction passage 404 is large, and the amount of fuel discharged at a high pressure is reduced. The energization timing to the solenoid 102 is controlled by a command from the engine control unit 123, so that it is possible to control the amount of fuel discharged at high pressure to the amount required by the internal combustion engine.

After the start of the compression step, the energization to the solenoid 102 is released at a certain timing. Then, the magnetic attraction force acting on the anchor part 118 disappears, and the rod 117 moves in the valve opening direction (rightward in FIG. 5) by the force of the rod urging spring 125 and collides with the suction valve 113. At this time, the anchor part 118 also moves in the valve opening direction together with the rod 117. However, the rod 117 collides with the suction valve 113 and stops, whereas the anchor part 118 overshoots due to the inertial force. The amount of overshoot varies depending on design parameters and operation states. For example, in a case where the rod 117 collides with the suction valve 113 when the suction valve 113 is in the valve opening position, since the acceleration distance is longer than when the suction valve 113 is in the closed position, the collision speed is high and the overshoot amount is large. As a result, the timing of returning from the overshoot also differs.

The timing chart of FIG. 6 shows, from top to bottom, a) the position of the plunger 108, b) the current (drive current) of the solenoid 102, c) the position of the suction valve 113, d) the position of the rod 117, e) the position of the anchor part 118, f) pressure in the pressurizing chamber 114, and g) solenoid part vibration. The horizontal axis shows time t.

According to a) the position of the plunger 108 in FIG. 6, the suction step is a period in which the position of the plunger 108 reaches from the top dead center to the bottom dead center, and the period of the return step and the discharge step is a period during which the position of the plunger 108 reaches from the bottom dead center to the top dead center. Furthermore, according to b) the current of the solenoid 102, a suction current is caused to flow through the solenoid 102, and the anchor part 118 and the rod 117 are sucked. Further, c) the position of the suction valve 113, d) the position of the rod 117, and e) the position of the anchor part 118 are changed in accordance with the generation of the magnetic attraction force by the current supply to b) the solenoid 102.

Hereinafter, the relationship between each part operation in each step and each physical quantity at that time will be described. First, regarding the suction step, when the plunger 108 begins to descend from the top dead center at time t0, f) the pressure in the pressurizing chamber decreases from a high pressure state of, for example, 30 MPa level. When the pressure in the pressurizing chamber becomes lower than the pressure in the space 413 on the upstream side of the suction valve seat 401 (substantially equal to the suction port 107) and the differential pressure acting on the suction valve 113 becomes larger than the urging force of the suction valve urging spring 119, the suction valve 113 starts a valve opening movement. At this time, the anchor part 118 moves with a delay from the suction valve 113, because the interval is short after energizing the solenoid 102. When the suction valve 113 opens, the fuel flowing into the inner diameter side of the suction valve seat 401 from the passage 460 of the suction valve seat 401 starts to be sucked into the pressurizing chamber 114.

The anchor part 118 engages with the rod 117 and moves together in the valve opening direction. At time t2 in FIG. 6, the rod 117 stops when the rod 117 collides with the suction valve 113, but the anchor part 118 continues to move as it is due to the inertial force. Thereafter, the anchor part urging spring 126 pushes back the anchor part 118 until the anchor part 118 engages with the rod 117. This overshoot operation is shown in OA in FIG. 6.

When shifting to the discharge step, the current of the solenoid 102 is supplied so that a magnetic attraction force is generated while the anchor part 118 is overshooting. For example, in the present embodiment, energization is started at time t3.

That is, after the mover 442 (the anchor part 118) starts moving in the valve opening direction, during the period from the passage of the mover opening position Xo442 (FIG. 4) indicating the position of the mover 442 when the solenoid 102 is not energized to the return to the mover opening position Xo442, energization of the maximum current (suction current) is started.

For example, when energization of the maximum current (suction current) is started during the period from the timing when the mover 442 (the anchor part 118) reaches the folding position of the overshoot to the timing when the mover 442 returns to the mover opening position Xo442, the impact force of the mover 442 can be increased.

On the other hand, when energization of the maximum current (suction current) is started during the period from the timing when the mover 442 (the anchor part 118) reaches the mover opening position Xo442 to the timing when the mover 442 reaches the folding position of the overshoot, the overshoot amount (distance) can be suppressed.

With this configuration, while the magnetic attraction force is generated, the overshooted anchor part 118 collides with the engagement part of the rod 117, so that the anchor part 118 can be sucked in a short time using the collision force.

The time of re-contact between the rod 117 and the anchor part 118 is indicated by t6. When the rod 117 moves in the valve closing direction and the engagement with the suction valve 113 is released, the suction valve 113 can be closed. After the time t7 when the anchor part 118 comes into contact with the fixed core 412, a magnetic resistance between the anchor part 118 and the fixed core 412 is small due to the contact; therefore, a sufficient magnetic attraction force is generated and a small current value (holding current) can be obtained only for holding the contact.

In the present embodiment, a condition for obtaining the maximum discharge amount of the pump is shown, and an example in which the suction valve 113 is closed in a state where the plunger 108 is near the bottom dead center is shown.

The current of the solenoid 102 flows a high current (suction current) before anchor attraction, and after aspiration, flows a lower current (holding current). That is, the holding current is smaller than the suction current.

In FIG. 6, the moved suction valve 113 collides with the suction valve seat 401 and stops, thereby bringing the valve closing state. After the valve closes, when the fuel pressure in the pressurizing chamber 114 rises together with the ascending motion of the plunger 108 and the fuel pressure reaches or exceeds the pressure of the fuel discharge port of the discharge valve mechanism 115, the fuel is discharged via the discharge valve mechanism 115 at a high pressure and is supplied to the common rail 121. Fuel pumping is performed until the plunger 108 reaches top dead center. During this time, the holding current may flow through the solenoid 102.

When the plunger 108 reaches the top dead center, the fuel pressure delivery again shifts to the suction step. After the suction step starts, the above operation is repeated. In the present embodiment, the current (holding current) of the solenoid 102 is energized across the top dead center. The timing of interrupting the current of the solenoid 102 is determined based on the timing of overshoot.

That is, if a delay time from when the current of the solenoid 102 is interrupted until when the anchor part 118 returns from the overshoot is Te, a timing at which the suction valve 113 is desired to be closed is interrupted by the delay time Te ahead of a timing at which the suction valve 113 is to be closed. In this manner, the momentum of overshoot can be utilized when sucking the anchor at a desired timing.

When the driving method according to the embodiment of the present invention is practiced, for example, a vibration waveform shown by g) solenoid part vibration can be measured. First, at time t2, vibration occurs when the rod 117 collides with the suction valve 113. This vibration is often relatively small. Subsequently, vibration at which the anchor part 118 collides with the fixed core 412 appears at time t7.

As described above, according to the present embodiment, responsiveness of closing a suction valve can be maintained even when the high-pressure fuel pump is increased in pressure or capacity of the high-pressure fuel pump is increased, thereby ensuring discharge efficiency. In particular, by energizing the solenoid 102 while the anchor part 118 overshoots, the overshooted anchor part 118 collides with the flange part 417*a* of the rod 117, so that the anchor part 118 can be sucked in a short time using the collision force.

Second Embodiment

FIG. 7 is used to explain an operation state of a high-pressure fuel pump according to a second embodiment of the present invention. FIG. 6 shows an embodiment in the case where the pump discharge amount is large, and FIG. 7 shows an embodiment in the case where the discharge amount is small. In this case, a timing at which the suction valve 113 is closed is a timing at which the plunger 108 reaches the vicinity of the top dead center.

First, in the suction step, as in the embodiment of FIG. 6, when the pressure in the pressurizing chamber becomes lower than the pressure in the space 413 on the upstream side of the suction valve seat 401 (substantially equal to the suction port 107) and the differential pressure acting on the suction valve 113 becomes larger than the urging force of the suction valve urging spring 119, the suction valve 113 starts a valve opening movement. In the example of FIG. 7, the current of the solenoid 102 is continued to be energized from the previous pressurizing step (discharge step). As a result, the anchor part 118 and the rod 117 are held in the valve closing position. When the suction valve 113 opens, the fuel flowing into the inner diameter side of the suction valve seat 401 from the passage 460 of the suction valve seat 401 starts to be sucked into the pressurizing chamber 114.

Subsequently, as the plunger 108 rises past the bottom dead center, the pump enters the return step. At this time, the suction valve 113 remains stopped in the valve opening state at the force f1 in the direction in which the valve opens, and the direction of the fluid passing through the suction valve 113 is reversed. That is, in the suction step, the fuel has flowed into the pressurizing chamber 114 from the passage of the suction valve seat 401. On the other hand, when returning to the rising step (return step), the pressurizing chamber 114 is returned in the direction of the passage of the suction valve seat 401. This step is the return step.

In the return step, under the condition of high engine speed, that is, when the rising speed of the plunger 108 is high, the closing force of the suction valve 113 by the return fluid increases, and the force f1 in the direction in which the valve opens becomes smaller. Under this condition, if the setting force of each spring force is wrong and the force f1 in the direction in which the valve opens becomes a negative value, the suction valve 113 is unintentionally closed. A flow rate larger than a desired discharge flow rate is discharged; therefore, the pressure in the fuel piping rises above the desired pressure, which adversely affects the combustion control of the engine. Therefore, under the condition that the rising speed of the plunger 108 is the largest, it is necessary to set each spring force so that the force f1 in the direction in which the valve opens is kept at a positive value.

Specifically, the rod urging spring 125 is strengthened, or the anchor part urging spring 126 or the suction valve urging spring 119 is weakened. In either case, the force required to suck the anchor part 118 toward the fixed core 412 side increases. Therefore, unless measures are taken, the suction response time of the anchor part 118 becomes long. Therefore, there is a case that bouncing off may occur, such as suction operation cannot be performed within a specified time, suction current must be increased, and it is necessary to increase energization time.

When energization of the current of the solenoid 102 is terminated at a certain timing, after a delay time Td, the anchor part 118 and the rod 117 move to the valve opening position, and the rod 117 collides with the suction valve 113 and stops. On the other hand, the anchor part 118 overshoots due to the inertial force and eventually returns with the force of the anchor part urging spring 126. When b) the current of the solenoid 102 is energized at a certain timing when the anchor part 118 overshoots, the anchor part 118 collides with the engagement part of the rod 117 in the state having the initial speed, whereby the rod 117 can be driven in the valve closing direction.

When the engagement of the rod 117 is released, the suction valve 113 closes, the pressure in the pressurizing chamber 114 increases, and the pressure pumping of fuel starts. That is, the discharge step is performed. Since the present embodiment shows the operation state in which the discharge flow rate is small, a period from when the pressure in the pressurizing chamber 114 increases until when the plunger 108 reaches the top dead center is shortened.

Also in this embodiment, as in the previous embodiment, the anchor part 118 overshoots and collides with the engagement part of the rod 117 with the momentum of the approaching distance coming back. With this configuration, the force driving the rod 117 becomes stronger than when there is no momentum, so that the rod 117 can be driven in a shorter time. Therefore, in order to increase the pressure or the capacity of the high-pressure fuel pump, even when the force f1 in the valve opening direction is increased, the responsiveness of closing the suction valve 113 can be maintained and drive current can be suppressed.

A time at which it is desired to close the suction valve 113 in order to obtain a desired flow rate is set as t7, the anchor part 118 overshoots after the drive current is stopped. When the delay time until collision with the engagement part of the suction valve 113 again is Te, the time to stop energizing the solenoid can be calculated as t7-Te. If the overshoot amount is too large and cannot return by the time at which the suction valve 113 should be closed, the mass and the moving distance of the anchor part 118, the spring force of the rod urging spring 125 and the spring with an anchor part 126, and the like are adjusted so as to obtain a practical delay time Te.

Also, as a measure of energization start timing (time t3), there is the delay time Td from when the drive current is stopped until when the anchor part 118 starts overshooting. Since the delay time Td is also a time adjustable by the mass, moving distance and spring load of moving parts (the anchor part 118 and the rod 117), designing can be made so that the present invention can be applied by selecting these appropriately.

Also in this embodiment, as in the first embodiment, when the rod 117 collides with the suction valve 113 (time t2), or when the anchor part 118 collides with the fixed core 412 (time t7), vibration originating from the solenoid is generated.

From the viewpoint of reducing the environmental burden, the spread of ethanol mixed gasoline typified by biofuel is expanding. Since ethanol mixed gasoline has lower energy density than gasoline not containing ethanol, when attempting to obtain the same output, the amount of fuel that needs to be injected by the fuel injection device 122 increases. The valve closing force due to the fluid acting on the suction valve 113 increases as the flow velocity of the fuel flowing through the suction valve seat 401 increases; therefore, when fuel injected by the fuel injection device 122 increases, the valve closing force increases.

That is, it is necessary to set each spring force so that the force f1 in the direction in which the suction valve 113 opens has a positive value. By applying this embodiment, it is possible to perform the valve closing operation of the solenoid valve without significantly increasing the magnetic attraction force characteristic with respect to the increased f1. As a result, vibration and noise can be kept relatively small. In addition, the aspiration current can be reduced and the energization time can be shortened, and the power consumption and the calorific value can be reduced.

Furthermore, according to embodiments of the present invention, there is also an advantage to cavitation erosion. When the anchor part 118 and the rod 117 move in the valve opening direction at time t2, a displaced fuel flow inside the solenoid is generated. If the rod 117 and the anchor part 118 suddenly stop, a sudden stop of the fuel which has been flowing so far causes water hammer, and cavitation occurs inside the solenoid. As shown in the embodiment of the present invention, if the anchor part 118 is gently overshot without abruptly stopping the anchor part 118, there is also an advantage to cavitation erosion with no water hammers as described above.

As described in the first and second embodiments, as shown in FIG. 5, the high-pressure fuel pump includes the rod 117 that urges the suction valve 113 in the valve opening direction, the mover 442 that drives the rod 117 in the valve closing direction, and the solenoid 102 that generates a magnetic attraction force for moving the mover 442 in the valve closing direction. Here, the mover 442 is formed separately from the rod 117.

Then, after the suction valve 113 starts moving from the suction valve closing position Xc113 in the valve opening direction, the rod 113 reaches the suction valve closing position Xc113 and further moves in the valve opening direction. That is, after the suction valve 113 starts to move in the valve opening direction from the suction valve closing position Xc113, the control device that controls the high-pressure fuel pump controls the drive current to be supplied to the solenoid 102 so that the rod 117 reaches the suction valve closing position Xc113 and further moves in the valve opening direction.

As a result, the movement amount D2 of the mover 442 (the anchor part 118) can be made larger than the movement amount D1 of the suction valve 113. As a result, the impact force when the mover 442 (the anchor part 118) collides with the flange part 417*a* of the rod 117 can be increased.

In detail, when the movement distance from the rod closing position Xc117 of the rod 117 to the suction valve closing position Xc113 is set as the rod movement distance DL (=D2−D1), after the suction valve 113 starts moving from the suction valve closing position Xc113 in the valve opening direction, the mover 442 completes the movement of the rod movement distance DL from the mover closing position Xc442 and further moves in the valve opening direction. As a result, the movement amount D2 of the mover 442 (the anchor part 118) can be made larger than the movement amount D1 of the suction valve 113.

Furthermore, practically, it is preferable that after the maximum current (suction current) as a first current flows to the solenoid 102, an intermediate current (holding current) as a second current lower than the maximum current flows, whereby the mover 442 moves in the valve closing direction, and the intermediate current is interrupted after the suction valve 113 starts moving from the suction valve closing position Xc113 in the valve opening direction (after t1, FIG. 7). As a result, the mover 442 can be quickly moved in the valve opening direction.

It is preferable that the timing of switching the current value from the suction current to the holding current is after completion of the movement of the mover 442; however, it can be realized functionally if at least the mover 442 has started to move.

Further, as one embodiment, it is preferable that by the control device that controls the high-pressure fuel pump, after the maximum current (suction current) flows through the solenoid 102, an intermediate current lower than the maximum current flows, whereby the mover 442 moves in the valve closing direction, so that the intermediate current is interrupted after the plunger pressurizing the pressurizing chamber reaches the top dead center (t10, FIG. 6).

As a result, a timing at which the mover 442 (the anchor part 118) moves to the mover closing position Xc442 goes behind schedule, a prestroke effect can be utilized at the timing of applying the suction current of the next cycle. The prestroke effect means that by securing a stroke portion that is set when the mover 442 (anchor part 118) is stopped, the mover 442 (anchor part 118) is moved to the fixed core 412 without fail after energization of the suction current, thereby enabling the valve to be closed. The plunger 108 pressurizes the pressurizing chamber 114 by reciprocating by the cam 309.

If a time until the mover 442 returns to the valve closing position after the intermediate current is interrupted is long, an interrupting timing of the intermediate current may be advanced before the plunger reaches the top dead center.

Further, it is preferable that the intermediate current is interrupted after the plunger reaches the top dead center and then approaches the bottom dead center from the top dead center (t10, FIG. 7). This increases the prestroke effect.

Furthermore, it is preferable that the maximum current is made to flow to the solenoid 102 and the intermediate current lower than the maximum current is made to flow to the solenoid 102, so as to move the mover 442 in the valve closing direction, thereby interrupting the intermediate current after the suction valve 113 starts to move from the valve closing position to the valve opening position (after t1, FIG. 7).

From another point of view, it is preferable that the control device that controls the high-pressure fuel pump of the present embodiment moves the mover 442 in the valve closing direction by causing the intermediate current lower than the maximum current to flow after flowing the maximum current to the solenoid 102, thereby interrupting the intermediate current after the plunger reaches the top dead center. As a result, as described above, a prestroke effect can be obtained.

(Modification)

The present invention may be applied depending on the operation state of the internal combustion engine. For example, when the engine speed is high, the pump also needs to operate at high speed; therefore, it is effective to apply the control method of the present invention only under such operating conditions.

In the embodiment of FIGS. 6 and 7, since the delay time Te is relatively short, the solenoid current has continued to be energized until reaching the suction step after the discharge step is completed; however, when the delay time Te is long, the present invention can be applied by stopping energization before the end of the discharge step. That is, the effect of the present invention can be obtained by driving so that the suction valve closing timing of the next cycle comes at the timing of returning from the overshoot of the anchor part 118.

It should be noted that the present invention is not limited to the above-described embodiment, but includes various modifications. For example, the above-described embodiments have been described in detail for easy understanding of the present invention, and are not necessarily limited to those having all the configurations described. In addition, a part of the configuration of one embodiment can be replaced by the configuration of another embodiment, and the configuration of another embodiment can be added to the configuration of one embodiment. Further, it is possible to add, delete, and replace other configurations with respect to part of the configuration of each embodiment.

Further, each of the above-described configurations, functions, and the like may be realized by hardware by designing part or all of them, for example, by an integrated circuit. In addition, each of the above-described configurations, functions, and the like may be realized by software by interpreting and executing a program that the processor realizes each function. Information such as a program, a table, a file or the like that realizes each function can be stored in a memory, a recording device such as a hard disk, or an SSD (Solid State Drive), or a recording medium such as an IC card, an SD card, or a DVD.

REFERENCE SIGNS LIST

12 fuel discharge port
101 pump body
102 solenoid
103 low-pressure fuel suction port
104 pressure pulsation reduction mechanism
106 flow control valve
108 plunger
113 suction valve
114 pressurizing chamber
115 discharge valve mechanism
117 rod (rod part)
118 anchor part
119 suction valve spring
122 fuel injection device (injector)
123 engine control unit (ECU)
125 rod urging spring
126 anchor part urging spring
201 cylinder
313 seal holder
314 plunger seal
401 suction valve seat
405 seat part
411 outer core
412 fixed core
415 cover part
418 seal ring
423 yoke
441 anchor sliding part (sliding part)
442 mover

The invention claimed is:

1. A high-pressure fuel pump comprising:

a rod that urges a suction valve in a valve opening direction;

a mover that drives the rod in a valve closing direction; and a solenoid that generates a magnetic attraction force to move the mover in the valve closing direction, wherein the rod reaches a suction valve closing position and then moves in the valve opening direction after the suction valve starts moving from the suction valve closing position in the valve opening direction, and the mover is configured to be movable in the valve opening direction independently of the rod.

2. The high-pressure fuel pump according to claim 1, wherein when a moving distance from a rod closing position of the rod to the suction valve closing position is a rod moving distance, after the suction valve starts moving from the suction valve closing position in the valve opening direction, the mover completes a movement of the rod movement distance from the mover closing position and further moves in the valve opening direction.

3. The high-pressure fuel pump according to claim 1, wherein an intermediate current lower than a maximum current flows after the maximum current flows through the solenoid, and the mover moves in the valve closing direction, and the intermediate current is interrupted after the suction valve starts moving from the suction valve closing position in the valve opening direction.

4. The high-pressure fuel pump according to claim 1, wherein an intermediate current lower than a maximum current flows after the maximum current flows through the solenoid, and the mover moves in the valve closing direction, and the intermediate current is interrupted after the plunger that pressurizes the pressurizing chamber reaches a top dead center.

5. The high-pressure fuel pump according to claim 1, wherein an intermediate current lower than a maximum current flows after the maximum current flows through the solenoid, the mover moves in the valve closing direction, and the intermediate current is interrupted before the plunger that pressurizes the pressurizing chamber reaches a top dead center.

6. A high-pressure fuel pump comprising:

a rod that urges a suction valve in a valve opening direction;

a mover formed separately from the rod; and a solenoid that generates a magnetic attraction force for moving the mover in a valve closing direction, wherein an intermediate current lower than a maximum current flows after the maximum current flows through the solenoid, and the mover moves in the valve closing direction, and the intermediate current is interrupted after the suction valve starts moving from a suction valve closing position to a valve opening position, and the mover is configured to be movable in the valve opening direction independently of the rod.

7. The high-pressure fuel pump according to claim 6, wherein the intermediate current is interrupted after the plunger that pressurizes the pressurizing chamber reaches a top dead center and approaches a bottom dead center from the top dead center.

8. The high-pressure fuel pump according to claim 6, wherein energization of the maximum current is started during a period from a passage of a mover opening position indicating a position of the mover when the solenoid is not energized to a return to the mover opening position after the mover starts moving in a valve opening direction.

9. A control device configured to control a high-pressure fuel pump that comprises: a rod that urges a suction valve in a valve opening direction; a mover that drives the rod in a valve closing direction; and a solenoid that generates a magnetic attraction force to move the mover in the valve closing direction, wherein the rod reaches a suction valve closing position and the control device then controls a drive current to be supplied to the solenoid so that the rod moves in the valve opening direction after the suction valve starts to move from a suction valve closing position in the valve opening direction, where the mover is configured to be movable in the valve opening direction independently of the rod.

10. The control device according to claim 9, wherein the mover is made to move in the valve closing direction by causing an intermediate current lower than the maximum current to flow after flowing a maximum current to the solenoid, and the intermediate current is interrupted after the suction valve starts to move from a valve closing position to a valve opening position.

11. The control device according to claim 9, wherein the mover is made to move in the valve closing direction by causing an intermediate current lower than the maximum current to flow after flowing a maximum current to the solenoid, and the intermediate current is interrupted after the plunger reaches a top dead center.

* * * * *